United States Patent [19]

Caldwell

[11] 4,340,025

[45] Jul. 20, 1982

[54] PULLEY FOR COMPOUND ARCHERY BOW

[76] Inventor: Joseph M. Caldwell, 2259 W. Big Tujunga Canyon, Tujunga, Calif. 91042

[21] Appl. No.: 115,954

[22] Filed: Jan. 28, 1980

[51] Int. Cl.[3] ..... F41B 5/00

[52] U.S. Cl. ..... 124/86; 124/23 R; 124/DIG. 1

[58] Field of Search ..... 124/23 R, 24 R, 90, 124/80, 86, 1, DIG. 1; 254/396, 398; 242/47.5

[56] References Cited

U.S. PATENT DOCUMENTS

| | | | |
|---|---|---|---|
| 4,054,118 | 10/1977 | McKee et al. | 124/23 R |
| 4,064,862 | 12/1977 | Groner | 124/23 R |
| 4,079,723 | 3/1978 | Darlington | 124/24 R |
| 4,185,374 | 1/1980 | Shepley | 124/90 X |
| 4,187,826 | 2/1980 | Killian | 124/24 R |
| 4,261,320 | 4/1981 | Barna | 124/24 R |

*Primary Examiner*—Richard C. Pinkham
*Assistant Examiner*—William R. Browne
*Attorney, Agent, or Firm*—Christie, Parker & Hale

[57] ABSTRACT

An archer's compound shooting bow has rigging cables and pulleys arranged to eliminate torque on the limbs when the bow is fully drawn and to permit an arrow to fly true past the rigging when the bow approaches its rest condition. Each pulley has two grooves receiving an adjacent rigging cable. The grooves have variable separation at different locations along the pulley rim. Each pulley is mounted on a limb alongside the opposite rigging cable dead end. As to each limb, the connection of the opposite cable dead end and the location of the adjacent cable tensions are arranged, in respect to their magnitudes at full draw, to apply no net torsional moment to the limb about its torsional axis.

The separation between the pulley grooves corresponding to the rest condition permits arrow feathers to pass the rigging cables without contact, which is not true at full draw. The groove for the shooting string is normal to the pulley rotational axis. The other groove is substantially helical to the first groove.

The pulley is ring-shaped and is fabricated from an extrusion having an annular cross section.

24 Claims, 23 Drawing Figures

Fig. 1
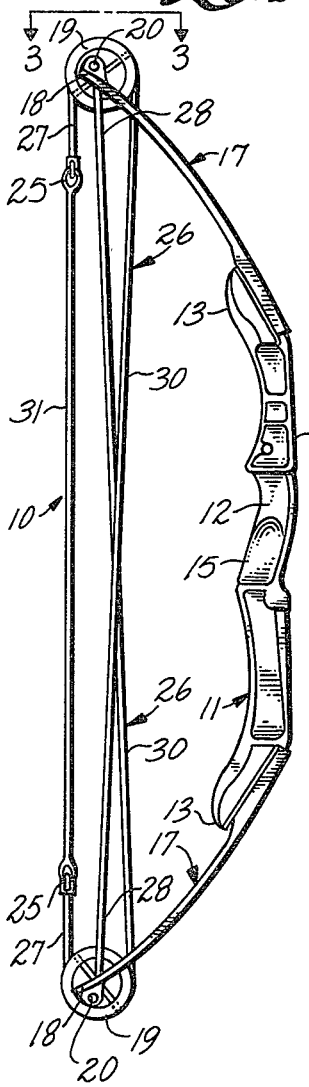
Fig. 3
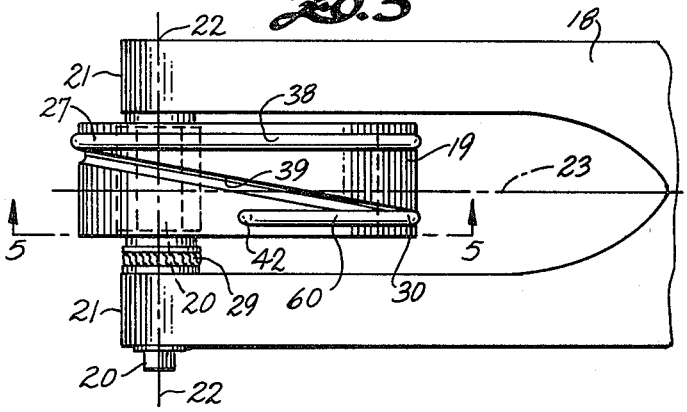
Fig. 4
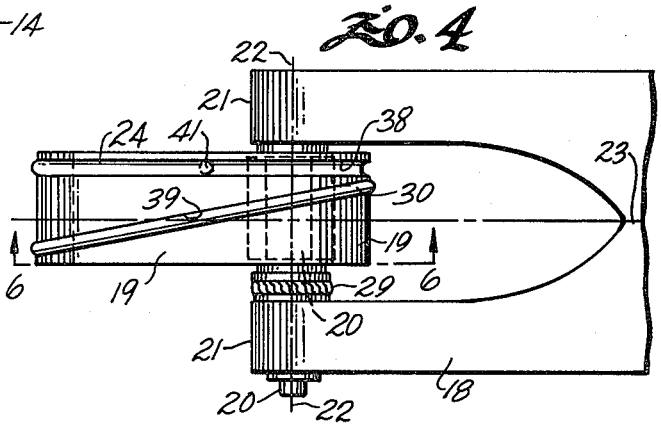
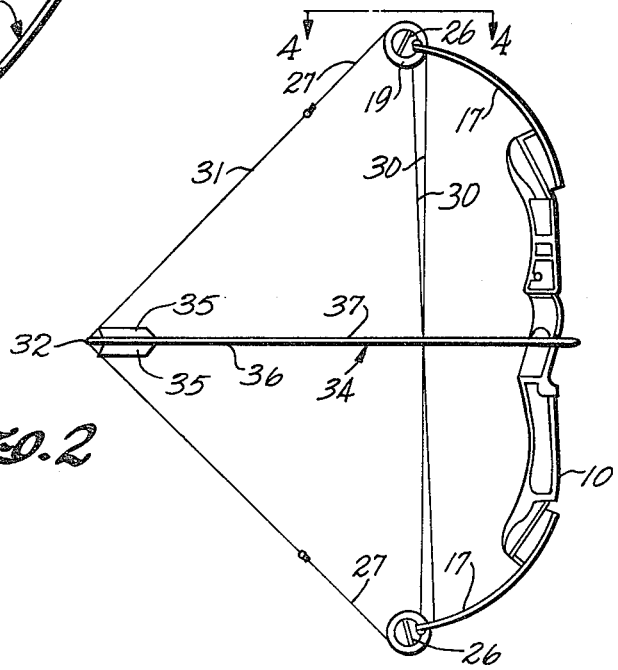
Fig. 2

PRIOR ART

Fig. 13
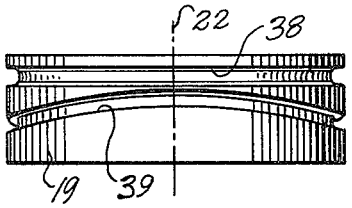
Fig. 15
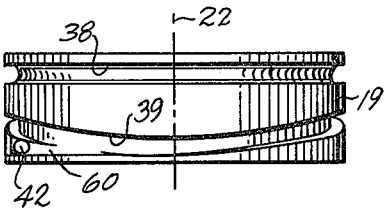
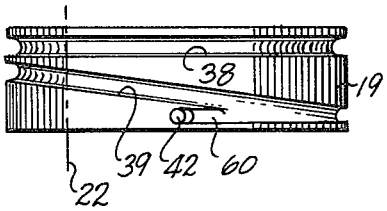
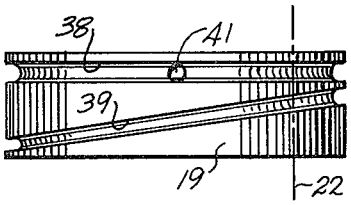
Fig. 14
Fig. 16
Fig. 18
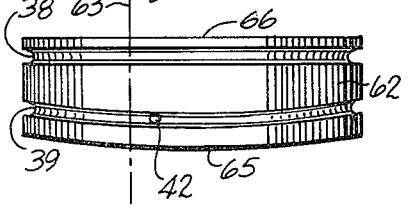
Fig. 19
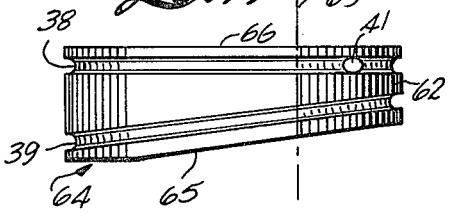
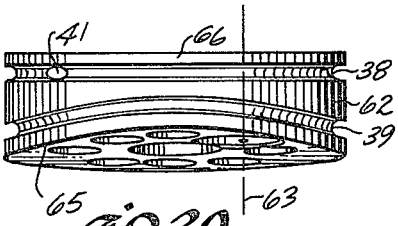
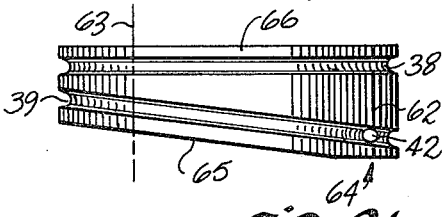
Fig. 20
Fig. 21
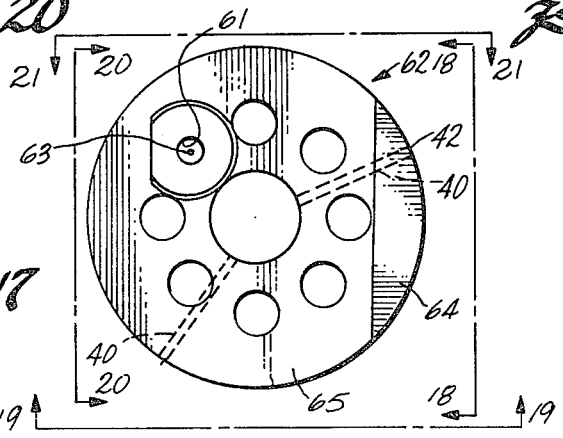
Fig. 17

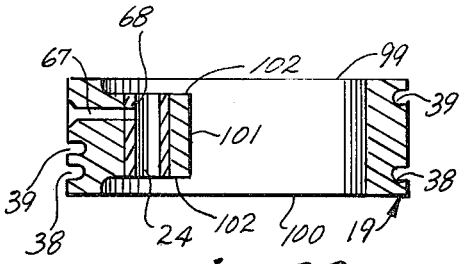
FIG. 22
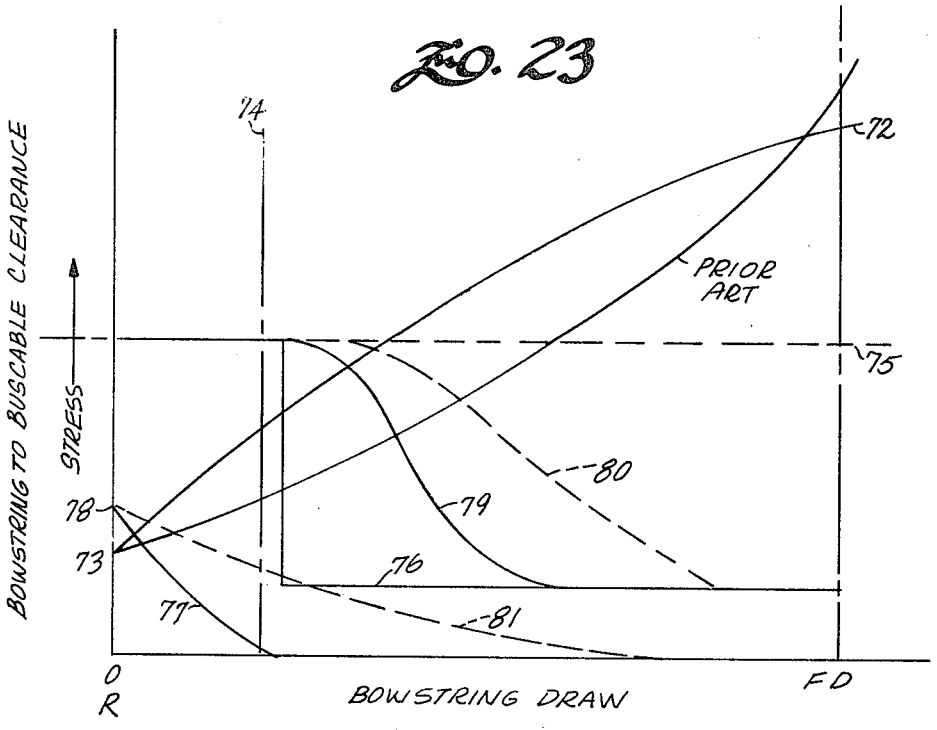

PULLEY FOR COMPOUND ARCHERY BOW

BACKGROUND OF THE INVENTION

1. Field of the Invention

This invention pertains to archers' compound bows. More particularly, it pertains to compound bows in which the pulleys and the rigging are arranged to eliminate torque on the limbs when the bow is at a fully drawn condition and to provide adequate spacing for the arrow fletchings to pass clear of the rigging when the bow is at or near a relaxed condition. A process for manufacturing a new pulley for use in compound shooting bows is also provided.

2. Review of the Prior Art

So far as is known, all archers' compound shooting bows use pulleys and rigging which produce substantial torque on the limbs when the bow is drawn. Archery is a rapidly expanding sport worldwide, and improvements in compound bows are continually being sought to improve their performance. This invention provides substantial performance improvements in archers' compound shooting bows.

The present invention is believed to have increased significance when used in a compound bow with intermediately pivoted limbs, such as are shown in U.S. Pat. No. 4,183,345 but the invention can be used to advantage in more conventional compound bows, such as are shown in U.S. Pat. No. 3,486,495. The new pulley may be used to advantage in compound bows having split limbs with a fork or notch at the outer ends of the limbs for mounting the new pulley directly to the end of the limb. The new pulley can also be used with bracketed limbs in which the pulley is mounted in a bracket affixed to the outer end of the limb.

Compound bows involve complex rigging of the bowstring over pulleys carried by the bow limbs. The original circular compound pulley had two parallel grooves for receiving (1) the end of the rigging cable leading to the bowstring hook (the shooting string) and (2) the end of the rigging cable running to the other limb (the bus cable). At each limb there are three connections of cables to the limb; (a) the dead end of the bus cable for the other pulley, (b) the bus cable which had its dead end connected to the other limb, and (c) the shooting string. Conventionally, the connection for (a) is to the pulley axle alongside the pulley. Bus cable (b) and shooting string (c) are connected to the pulley via the pulley grooves. When a compound bow is at a fully drawn condition, the load on each bus cable is typically on the order of two to three times the load on the shooting string. The loads on the bus cables are substantially equal. The loads of these cables are applied to each limb as the bow is drawn from a rest position to a fully drawn position. Each cable produces a torsional moment about the point where the pulley axle axis crosses the limb centerline, equal to the product of the load on the cable times the moment arm of the cable. The moment arm of a cable is defined as that distance, along the pulley axis, of the point of apparent or actual intersection of the cable with the pulley axis, measured from the limb torsional centerline or axis. The limb torsional centerline is defined as the locus of points along the limb about which torsional deflections of the limb occur. The location of the limb torsional centerline is a function of the limb geometry. For example, in a symmetrical limb, the limb torsional centerline coincides with the limb axis of symmetry.

In all known prior art arrangements, the summation of all bowstring and bus cable torsional moments about the point where the pulley axle axis crosses the limb torsional centerline has never been zero at conditions of full draw. The result has been the imposition of substantial net torque, or torsional imbalance, on the limb at full draw of the bow. This torque was at a minimum (but never zero) in the relaxed strung condition of the bow due to decreased magnitudes of the cable loads. The presence of net torque at full draw produced the problem of twisting stresses, imposed on the limbs, which are progressively additive to bending stresses experienced by the limbs, as the bow is drawn from a rest position. Thus, when flexed, the limbs of compound bows have been under significant twisting stresses, caused by torsional imbalance, which eventually leads to a degradation of limb laminal fibers and possible delamination of the limb during repeated use of the bow, and tends to shorten the useful life of the limbs of a compound bow. Typically, reinforcement of the limb tips of compound bows has been required to counteract twisting stresses on the limbs. But reinforcement of limb tips increases the inertial mass of the limbs, which disadvantageously results in slower arrow flight and a less efficient bow. For a given drawing force of a bow, an increased inertial limb mass means correspondingly less force is available for acceleration of the arrow.

Other limitations in present compound bow design are due to the presence of torsional imbalance, one of which is unsightly and appreciable angular deflection of the limb tips when the bow is at a fully drawn condition. When an arrow is shot from such a bow, the imbalance causes lateral movement of the bowstring in traveling from drawn to relaxed states as the net torque (and the corresponding angular deflection of the limb tips) is reduced. Such lateral movement produces a lateral cast (deflection) on the nock (rear end) of the arrow, causing the arrow to flex as it leaves the bowstring, and thus not fly true to the target. This effect conventionally has been partially reduced by painstaking experimental selection of arrows having the correct spine (lateral stiffness) matched to the bow as to draw length and draw weight. However, for the neophyte archer, experimentation with different (and expensive) arrows is a costly and undesirable solution.

The prior art attempted to solve the aforementioned problems by resorting to a narrow pulley rigged such that one bus cable groove was positioned on the limb torsional centerline. This operated to reduce the amount of torsional moment imbalance about the point where the pulley axis crossed the limb centerline, but not to substantially eliminate the imbalance. It was still true that the summation of angular moments about the limb centerline was not zero. Although torque was reduced, a new problem arose. The bowstring was situated so close to the bus cables that the arrow fletchings would not clear the bus cables as the arrow was shot from the bow. The prior art solved the problem of reduced and inadequate bowstring/bus cable clearance by mounting a stiff probe to the handle riser of the bow. The probe extended toward the user past the bus cables; the probe was used to displace the bus cables laterally away from the bowstring adjacent the path of movement of the bowstring. The probe, however, presented a safety hazard. Compound bows are widely used by hunters in relatively inaccessible regions where help is not readily available. If a hunter, while climbing or otherwise, should lose his balance and fall on his bow, the probe could spear him.

The use of this invention in a compound bow provides a simple and effective way to substantially eliminate torsional imbalance on the limbs at full draw of the bow, while providing adequate clearance between the bowstring and the bus cables for the arrow fletchings as the fletchings, located adjacent the rear or nock end of the arrow, move past the bus cables.

The present invention provides other advantages which are set forth in the following detailed description of preferred embodiments thereof.

SUMMARY OF THE INVENTION

This invention provides substantial improvements in the performance of compound shooting bows. The structural and procedural aspects of the invention are simple, efficient, safe and reliable. This invention provides many advantages over conventional compound shooting bows and, as noted, substantially eliminates torsional imbalance on the limbs at full draw of the bow, while providing adequate clearance between the bowstring and the bus cables for the arrow fletchings as the arrow is shot from the bow. Some of the advantages of the present invention, as more fully set forth below, include a reduced tendency of the bow to jump from the user's hand upon release of the drawstring, due to reduced inertial mass of the forward moving portions of the bow, and increased limp tip speed upon release of the bowstring.

Another advantage of this invention is that the bow does not impart a lateral cast upon an arrow as it is shot, thereby producing truer arrow flight and more efficient selection of arrows.

A further advantage is that the bow has substantially no net torsional moment imbalance at full draw, so that the useful life of the bow is increased.

Yet another advantage is that the new pulley for a compound bow, when rigged in accordance with the teachings of this invention, both substantially eliminates torsional imbalance in the limbs at full draw of the bow and provides adequate clearance between the bowstring and the bus cables for the arrow fletchings as the arrow is shot from the bow, without requiring a deflection probe for the bus cables.

As a further advantage, this invention provides a simple and efficient process for manufacturing such a pulley.

Generally speaking, this invention provides a compound bow in which the pulleys and the rigging are arranged to substantially eliminate torsional imbalance on the limbs when the bow is at a fully drawn condition and to provide adequate spacing for the arrow fletchings to pass clear of the rigging when the bow is at or near a relaxed strung condition. A compound archery bow includes a rigid elongate handle riser assembly having opposite ends and a central handle portion. A pair of substantially identical limbs are disposed one at each end of the riser assembly. Each limb defines an outer limb tip at one of the opposite ends of the bow. A pulley is mounted eccentrically to the end of each limb for rotation about an axle connected to the limb. A rigging cable is reeved on each pulley between a shooting string end associated with the pulley and a dead end associated with the opposite limb. Each cable, between the dead end and the pulley, has a bus portion extending from the pulley to the opposite limb of the bow. Each pulley has a pair of grooves for receiving a portion of the corresponding cable adjacent the shooting string end and the bus portion.

Each pulley is mounted to its limb in a manner which prevents torsion of the limb at full draw of the bow. The connection of the opposite cable dead end to its limb and of the location of application of the adjacent cable bus portion and shooting string end portion tensions on the axle are arranged, in respect to the magnitudes of such tensions at full draw of the bow, to apply no net moment to the limb about the limb torsional axis.

The pulley grooves are variably spaced from each other at different locations along the pulley rim. At locations along the pulley rim groove corresponding to the relaxed strung state of the bow, the spacing of the grooves is sufficient to enable arrow fletchings to pass the bus cables without contact. The spacing of the pulley grooves corresponding to the relaxed strung condition is greater than the spacing at the location along the grooves corresponding to the fully drawn condition of the shooting string. When the bow is fully drawn the limb experiences no net torsional imbalance about its torsional axis. When the arrow is shot, there is sufficient clearance between the shooting string and the bus cables to assure that there is no contact between the arrow and the bus cables.

A process for manufacturing the new pulley for a compound bow by means of extrusion is also provided. The pulley is annular in substantially the form of a ring and has a lug-shaped projection extending inwardly across its axle. The pulley is fabricated from an extrusion having an annular cross section including the lug but without the axle hole. The annular extrusion is cut into slices having a width equal to the width of the pulley.

BRIEF DESCRIPTION OF THE DRAWINGS

The above-mentioned and other features of this invention are more fully set forth in the following detailed description of presently preferred embodiments of this invention, which description is presented with reference to the accompanying drawings, wherein:

FIG. 1 is an elevation view of a compound bow, in a relaxed strung condition, according to this invention;

FIG. 2 is an elevation view of the bow shown in FIG. 1 in a condition of full draw;

FIG. 3 is a fragmentary enlarged view taken along line 3—3 in FIG. 1;

FIG. 4 is a fragmentary enlarged view taken along line 4—4 in FIG. 2;

FIG. 13 is an elevation view of the pulley shown in FIGS. 3-5 at about the 10 o'clock position of the pulley as depicted in FIG. 5;

FIG. 14 is an elevation view of the same pulley at about the 1 o'clock position thereof as depicted in FIG. 5;

FIG. 15 is an elevation view of the same pulley at about the 4 o'clock position thereof as depicted in FIG. 5;

FIG. 16 is an elevation view of the same pulley at about the 7 o'clock position thereof as depicted in FIG. 5;

FIG. 17 is an elevation view of another embodiment of the new pulley;

FIG. 18 is a view taken along line 18—18 in FIG. 17;

FIG. 19 is a view taken along line 19—19 in FIG. 17;

FIG. 20 is a view taken along line 20—20 in FIG. 17;

FIG. 21 is a view taken along line 21—21 in FIG. 17;

FIG. 22 is a cross-sectional elevation view taken along line 22—22 in FIG. 5; and FIG. 23 is a graph illustrating design considerations for a pulley according to this invention.

DETAILED ANALYSIS OF THE PRIOR ART

Figure 12:
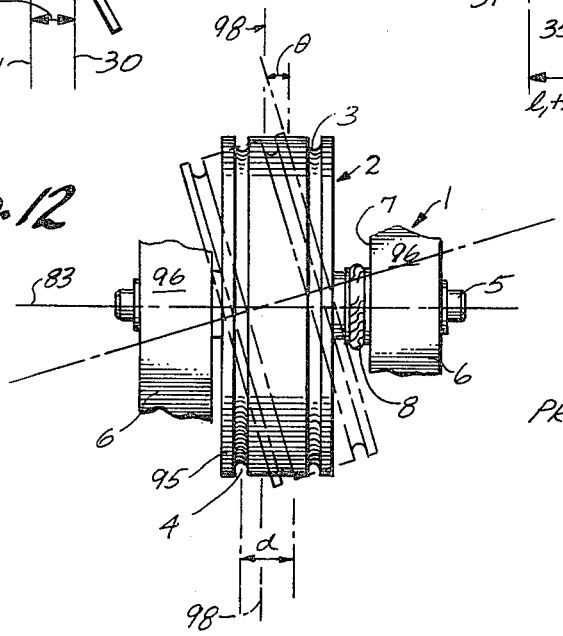
FIG. 12 is an end view, exaggerated for the purpose of illustration, of the tip end of a bow limb illustrating the effect of net torsional imbalance about the limb torsional axis in a prior art arrangement of the type to which FIG. 9 pertains.
Figure 9:
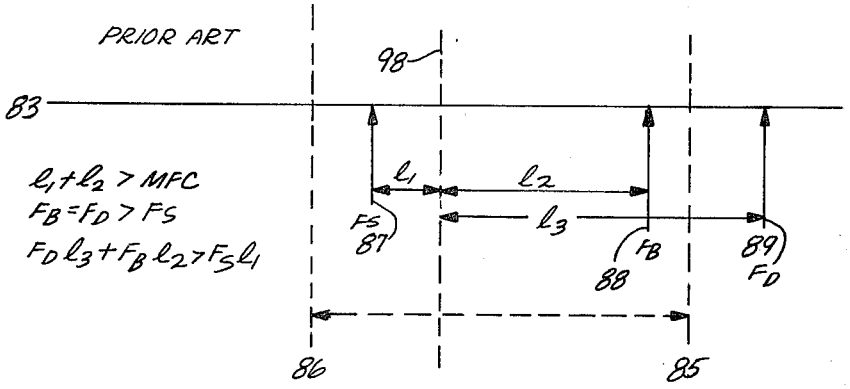
FIG. 9 is a force diagram illustrating an early prior art pulley arrangement.

An early rigging pulley for a compound shooting bow was of right circularly cylindrical configuration and had two parallel grooves defined in its circumferential rim surface for receiving (a) the portion of the rigging cable leading to the bowstring hook (the bowstring) and (b) the portion of the cable running to the other limb (the bus cable). FIG. 9 is a force diagram illustrating torsional imbalances produced in a notched limb 1 bow utilizing a circular compound pulley 2 having parallel grooves 3 and 4 as shown in FIG. 12. In FIG. 12, pulley 2 is shown mounted on an axle 5 between the limb end arms 6 which define the sides of a limb end notch 7 in which the pulley is disposed. The axle is supported by the limb end arms. FIG. 12 also shows that the dead end 8 for the bus cable for the opposite limb of the bow is connected to the axle in the notch. Pulley groove 3 is for the bus cable associated with pulley 2 and groove 4 is for the shooting string end of the rigging cable associated with the pulley. Grooves 3 and 4 are disposed in separate parallel planes normal to the axle centerline 83 which corresponds to the rotational axis of the pulley about the axle. The distance between grooves 3 and 4 along axis 83 is sufficient to cause the bus cables to be spaced laterally from the shooting string, at the nock point on the shooting string, adequately to provide the minimum fletching clearance MFC therebetween. In FIG. 12, the limb torsional axis is represented by line 98.

In FIG. 9, which is presented relative to pulley 2 shown in FIG. 12, the pulley axis 83 and the limb torsional axis 98 are shown. 85 and 86 represent side walls of the pulley and so represent the width of the pulley. The arrows 87, 88 and 89 represent force vectors for the cable tensions in the rigging of pulley 2. 87 represents the shooting string force vector and has a magnitude $F_s$ at full draw. Since the pulley has parallel grooves, the shooting string (associated with pulley groove 4) was displaced a constant distance $l_1$ from limb torsional axis 98. 88 represents the tension in the bus cable engaged in pulley groove 3 and has a magnitude $F_B$ at full draw. Since bus cable groove 3 is parallel to the groove for the shooting string, vector 88 is displaced a constant distance $l_2$ from the limb torsional axis. Vector 89 represents the tension, having a magnitude $F_D$ at full draw, on the opposite cable dead end 8 which is seized about the pulley axle at a constant distance $l_3$ from the limb torsional axis.

Due to bow symmetry, the magnitude of vector 89 equals the magnitude of vector 88. Thus there was equal tension on the bus cable and the opposite cable dead end; $F_D=F_B$. Also, at full draw, the bus cable tension was on the order of 2 to 3 times the shooting string tension; $F_B>F_S$. Due to the width of the pulley, the distance between the shooting string and the bus cables is expressed as the sum of $l_1+l_2$ and is always greater than the minimum fletching clearance required for the arrow fletchings to pass the bus cables along the path of movement of an arrow shot from the bow.

The total torsional moment about limb torsional axis 98 is the sum of the torsional moments arising from each cable. Each torsional moment is equal to the product of the tension in the relevent cable multiplied by the displacement of the cable from the limb torsional axis. Thus, as shown in FIG. 9, the torsion about limb torsional axis 98 is equal to $F_B l_2$ plus $F_D l_3$ minus $F_S$ times $l_1$ and did not equal zero. As the tension in the shooting string was less than the tension in the bus cables, and $l_1$ is less than $l_2$, it can be seen that for a prior art parallel pulley 2, torsional moments about limb torsional axis 98 could never approach zero at any condition of bowstring draw. To the contrary, when a bow equipped with pulleys 2 was fully drawn, there was substantial torque applied to the ends of the bow limbs. However, there was an adequate fletching clearance between the shooting string and the bus cables.

The result of the prior art arrangement shown in FIG. 9 was the imposition of substantial torque on the limbs at full draw of the bow. The effect of such full draw torque is shown in FIG. 12 by the broken lines which illustrate the angular deflection of the limb in response to the torque. Limb torque was reduced but not zero in the relaxed state of the bow.

Figure 10:
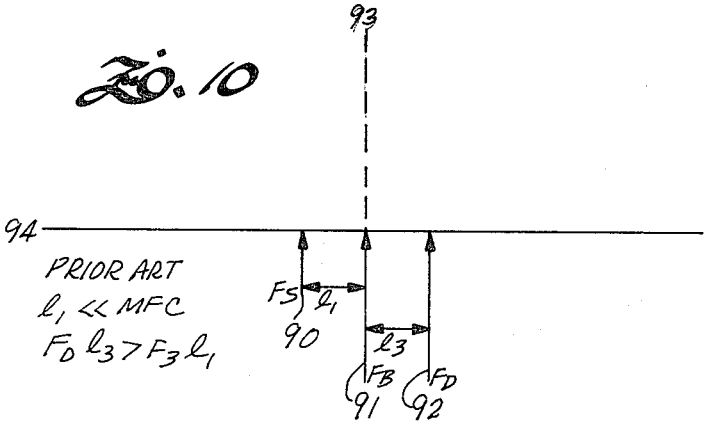
FIG. 10 is a force diagram illustrating a later prior art pulley arrangement.

Subsequently, an attempt was made to solve the problem illustrated in FIGS. 9 and 12 by using a pulley of substantially reduced width; the forces associated with this prior art arrangement are illustrated in the force diagram of FIG. 10. In FIG. 10, shooting string force vector 90 is displaced a distance $l_1$ from limb torsional axis 93. The narrow pulley was mounted so that the bus cable 91 lay on the limb torsional axis and had no moment arm by which to exert torsional stress on the limb. The opposite cable dead end was seized about the pulley axle and is represented by vector 92 displaced a constant distance $l_3$ from the limb torsional axis 93. As can be seen from the length of the vectors from pulley rotational axis 94, the tension in the shooting string remains at full draw less than the tension in either of the bus cables. The torsional moment about limb torsional axis 93 was equal to $F_D \times l_3 - F_S \times l_1$. The bus cable at each limb had no moment about that limb and could exert no torsional moment about the limb torsional axis. However, since vector 90 has a lesser magnitude than vector 92, the arrangement represented in FIG. 10 substantially reduced but did not fully eliminate torsional inbalance about the limb torsional axis at full draw of the bowstring. Moreover, since the bus cable was mounted on the limb torsional axis, the shooting string to bus cable clearance is equal to $l_1$, the distance that the shooting string groove was located from limb torsional axis. This distance was much less than the minimum fletching clearance required for an arrow to fly pass the bus cables without incurring contact. This latter problem was solved by mounting a stiff probe from the bow handle riser for deflecting the bus cables laterally away from the shooting string.

As noted, FIG. 12 illustrates angular deflection of a limb tip due to torsional imbalance. From an inspection of the solid and broken line illustrations of FIG. 12, it can be seen that pulley groove 4 for the shooting string will be displaced a horizontal distance d in response to torsional imbalance at full draw of the bow. When a torsionally imbalanced bow, such as is depicted in FIG. 12, is released from a full draw condition, the pulley will rotate back through angle $\theta$ to its original position and the shooting string groove will move horizontally a distance d, imparting a substantial cast to the arrow. This cast, among other things, affects the line of flight of the arrow and thus the accuracy of the bow.

The torsional stress and angular stress situations reviewed above create several problems in an archer's bow. The torsional stresses are substantial and are created in a bow limb designed to flex only in bending. The bow limbs usually are laminated. Torsional stresses, additive to the bending stresses in the limb, are not readily accomodated in the limb and, over time, produce delamination of the limb. For these reasons, a need exists for a solution to the problem of torsional stress and torsional deflection of bow limbs without the disadvantages of previously described or used solutions.

DESCRIPTION OF THE ILLUSTRATED EMBODIMENTS

An archer's compound shooting bow 10 is shown in FIG. 1 and includes an elongate rigid handle riser assembly 11 which defines a handle 12 centrally between the opposite ends 13 of the riser assembly. The riser assembly has a rear face 14 which is of generally convex configuration and a concave forward face 15. Handle 12 is adapted to be engaged in and supported by a hand of the user of the bow. The riser assembly can be built up out of wood, or it can be defined by either a metal casting or a fabricated metal structure.

A pair of substantially identical elongate resilient limbs 17, flexible in bending and in torsion, are also components of bow 10. A limb is disposed at each end 13 of the riser assembly; the limbs define a pair of spaced outer limb tips 18 at opposite ends of the bow. As shown in FIG. 3 and FIG. 4, each outer limb tip 18 of the presently preferred embodiment has a forked geometry consisting of substantially symmetric limb end arms 21. The limbs 17 preferably are of a laminated construction having outer layers of a suitable fiberglass material and an inner layer or layers of wood. The techniques for laminating bow limbs are well known, and any suitable technique used to define the flexing limbs of conventional compound bows, i.e., bows known prior to the present invention, may be used to make the limbs of a bow of the present invention.

A pulley 19 is mounted eccentrically to the movable end of each limb between the limb end arms 21 for rotation about an axis 20 connected to the limb. Each axle 20 defines a pulley rotational axis 22 disposed transversely of a torsional axis 23 of the limb 17. The limb torsional axis 23 is defined as the locus of points along the limb where torsional stresses are balanced and about which torsional deflection occurs. The location of the limb torsional axis is solely a function of the limb geometry. The torsional axis of a limb is analogous to the neutral axis of a beam subjected to bending stresses. For example, in a symmetrical limb, the limb torsional axis coincides with the limb axis of symmetry. In general, in a forked asymmetrical limb, where one of the limb end arms 21 is larger than the other limb end arm, the limb torsional axis 23 will be displaced somewhat toward the larger limb end arm. The presently preferred embodiment of this invention uses a pulley mounted on an axle between the end arms of a symmetrical forked limb. In the presently preferred embodiment, the pulley rotational axis 22 is disposed transversly of and is substantially perpendicular to and extends across the limb torsional axis 23. Axle 20 extends across a torsional axis of the limb. It should be understood, however, that this invention is not intended to be limited to compound bows having forked symmetrical limbs. Thus, this invention may be practiced to advantage in bows utilizing forked asymmetrical limbs, or bows utilizing limbs which are not forked and to which a pulley is attached by mounting means such as, for example, a bracket attached to the end of an unforked limb.

Each pulley 19 is eccentrically mounted to its limb in that, while the pulley is circular as shown, its axis of rotation does not coincide with its center of curvature. If desired, the improvement in compound bow pulleys provided by this invention may be practiced in the context of non-round pulleys, such as pulleys having elliptical profiles.

As shown in FIG. 1, a rigging cable 26 is reeved on each pulley 19 from cable portions on opposite sides of the pulley; i.e. between a shooting string end 27 associated with the pulley and a dead end 28 associated with the opposite limb 17. In the presently preferred embodiment, as shown in FIGS. 1, 3 and 4, the dead end 28 forms a loop 29 around the axle 20 of the opposite limb between its end arms 21 and adjacent the opposite pulley. The dead end is seized about the axle, or about a bushing carried by the axle, and tied off in a conventional manner. This invention,, however, may also be practiced with a bow where the dead end of the opposite rigging cable is connected to the limb, for example by additional pulleys.

Each cable 26, between its dead end 28 and the pulley, has a bus portion 30 extending from the pulley to the opposite limb 17 of the bow. Each bus portion 30 engages an eccentric pulley and connects to a shooting string end 27 of the cable. A shooting string 31 of compound bow 10 is not connected directly to the outer tip 18 of limb 17, but rather is connected between coupling hooks 25 carried at the shooting string ends 27 of rigging cables 26. The bowstring 31 is connected at one end to the live portion of one rigging cable and is connected at its other end to the live portion of the opposite rigging cable. Compound bow 10 of the presently preferred embodiment is of the two-wheel type in which the dead end 28 of each cable 26, opposite from its coupling hook 25, is connected to the axle of the eccentric pulley remote from its coupling hook; that is, the rigging cable which extends from the coupling hook 25 at the top end of the bow, as shown in FIG. 1, is reeved on and through the top eccentric pulley and has its opposite end 28 connected to the axle of the bottom eccentric pulley. The other cable is oppositely rigged.

The shooting string 31 has a nocking point 32 appropriately defined on the shooting string relative to handle 12. The shooting string is adapted to be drawn from a rest position (see FIG. 1) to a drawn limb-flexing position (see FIG. 2) upon application of drawing force to the shooting string at the nocking point in a direction away from handle 12.

The elongate bow limbs 17 are arranged to deflect in bending in response to drawing of the shooting string from a relaxed state to a drawn state. The geometry of the limbs and of the riser assembly and of the connection of the limbs to the riser assembly and the effective length of shooting string 31 establish the extent to which limbs 17 are stressed (flexed) when the bow is strung, as shown in FIG. 1, and the bowstring is in its rest position. This at-rest stressed condition of the limbs, in combination with the flexural stiffness (spring rate) of the limbs, determines the force which must be applied to the bowstring at nocking point 32 to draw the bowstring to its fully drawn position. This force is referred to as the "weight" of the bow. Thus, a bow which requires the application to the bowstring of a force of 65 lbs. to cause the bow to be operated to its drawn condition is said to be a bow having a weight of 65 lbs.

An arrow 34 carrying fletches (feathers) 35 adjacent its rear end 36 is engaged with the shooting string at the nocking point 32, and the bow is drawn, as shown in FIG. 2. When the shooting string is released, the arrow will be shot from the bow along a path of movement along shaft 37 of the arrow. Each rigging cable bus portion 30 extends from its pulley 19 to the opposite limb of the bow past the path of movement of the arrow. If the arrow is to fly true from the bow, the spacing between the rigging cables (where they pass the line of arrow movement) and the arrow shaft must be more than the distance by which the fletches extend from the arrow shaft; this spacing is the minimum fletching clearance MFC to which reference is hereinafter made.

Figure 5:
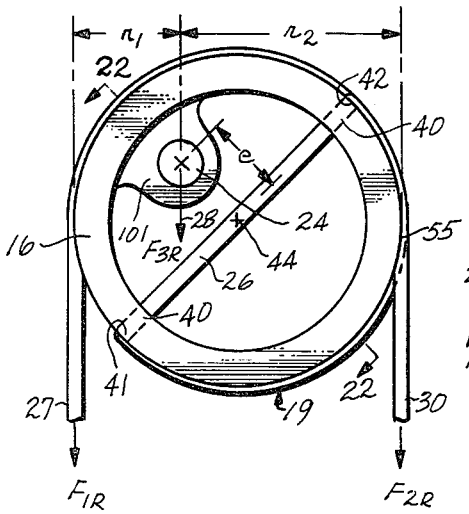
FIG. 5 is an elevation view of a new pulley according to this invention taken along line 5—5 in FIG. 3.

As shown in FIGS. 3 and 5, and also on FIGS. 13–16, the pulley rim surface is a right cylindrical surface having a directrix parallel to pulley rotational axis 22. The pulley has sides transverse to that axis. In the presently preferred pulley, the cylindrical rim surface is circular and is closed so as to extend entirely about the pulley axis of rotation.

As shown in FIGS. 3 and 4 and also in FIGS. 13 to 16, each pulley 19 defines in its periphery a pair of grooves 38 and 39 for receiving a portion of the corresponding rigging cable 26 adjacent its shooting string end 27 and its bus portion 30. The pulleys are substantially mirror images of each other. The groove 38 for the cable shooting string end portion 27 is defined in a plane transverse to the pulley rotational axis 22. In the presently preferred embodiment, groove 38 is defined entirely in a plane normal to pulley rotational axis 22 and is substantially parallel to the pulley side which is closest to it. Both sides of the pulley are normal to the pulley axis of rotation. The pulley groove 39 for the bus portion end 30 on each pulley is spaced from the other groove 38 along the pulley rim in a direction parallel to the pulley rotational axis 22. The spacing between the grooves varies according to a predetermined scheme at different locations along the length of groove 38. In the presently preferred embodiment of the new pulley, grooves 38 and 39 are defined in a common cylindrical surface of the pulley and extend around the entire circumference of the pulley rim. It is not necessary, however, that grooves 38 and 39 entirely circumscribe the pulley and it is not intended that this invention be so limited. This invention may be practiced to advantage with pulley grooves that extend partially along the pulley rim surface.

As shown in FIG. 3, FIG. 4, FIG. 5, and FIG. 6, cross-pulley cable passage 40 is defined through each pulley from a first selected location 41 on groove 38 to a second selected location 42 on the other groove 39 spaced along the rim surface from the first location. FIG. 5 illustrates a pulley, rigged in accordance with principles of this invention, in that angular position of the pulley which corresponds to a relaxed strung condition of the bow, such as is illustrated by the upper pulley in FIG. 1. The shooting string end portion 27 of rigging cable 26 is reeved in pulley groove 38 in a clockwise direction around the greater part of the pulley rim circumference, and enters the cross-pulley passage 40 at first selected location 41 to pass substantially across the interior of the pulley. Rigging cable 26 axially and diametrically traverses the pulley, and emerges from the cross-pulley passage at second selected location 42; from location 42, the cable is reeved in a clockwise direction in groove 39 for a short distance around the pulley and departs the pulley at a point of tangency 55 as bus cable portion 30. In the presently preferred embodiment, cross-pulley cable passage 40 is defined in a plane which is substantially perpendicular to the pulley axis of rotation.

Figure 6:
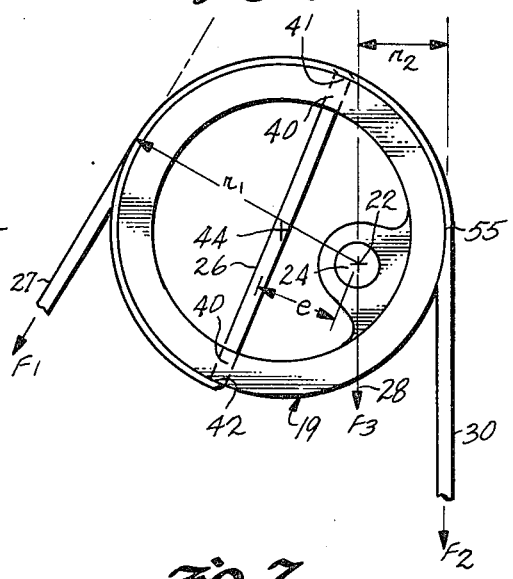
FIG. 6 is an elevation view of the pulley taken along line 6—6 in FIG. 4.

FIG. 6 illustrates the pulley in that angular position which corresponds to a fully drawn state of the bow, such as the upper pulley shown in FIG. 2.

Each pulley 19 is mounted eccentrically about an axle hole 24 for receiving axle 20 connected to each limb. In the presently preferred embodiment of this invention, each pulley is circular and defines a center 44 which is equidistant from all points on the pulley circumference. The pulley axis of rotation is eccentric to the pulley rim surface. The eccentricity e of pulley 19 is shown in FIGS. 5 and 6. This invention, however, may be practiced using any pulley defining an axis of rotation eccentric to a rim surface which extends at least partially around the circumference of the pulley. For example, a pulley which is ovoid or cam-shaped may be mounted about a pulley rotational axis which coincides with the point of intersection of its major and minor axes.

The rigging cables of a compound bow, when the bow is in its strung relaxed state, are taut. When the bow is drawn, increasing tension on the cables causes the limbs to flex. As the bow is drawn, the pulley shown in FIG. 5 rotates over-center in a counter-clockwise direction about pulley rotational axis 22 and eventually assumes the stable orientation shown in FIG. 6 which corresponds to the fully drawn state of the bow. When the shooting string is released, the pulley rotates back over-center in a clockwise direction about axis 22 and eventually returns to the orientation shown in FIG. 5. As noted, each bus cable 30 connects the second selected location 42 on each pulley with dead end loop 29 seized to the pulley axle on the opposite limb. As the bow is drawn and the upper pulley rotates in a counter-clockwise direction, point 42 moves in the direction away from the opposite limb, causing bus cable 30 to be taken up in pulley groove 39 and causing the opposite limb to be made to flex. One purpose of the bus cable, therefore, is to cause rotation of its pulley to cause flexing of the opposite limb as the bow is drawn.

The flexing of the limbs as the bow is drawn is caused by increasing tensions in the cable portions 27 and 30 and in the opposite cable dead end portion 28. Each cable portion has an effective point of application of rigging cable tension load to its pulley. The opposite cable dead end has an effective point of application of load on its axle. These tension loads may be analyzed at either limb tip as force $F_1$ in shooting string 27, force $F_2$ in bus portion 30, and force $F_3$ in the opposite cable dead end 28 which is seized about the pulley axle by loop 29. The forces act in a vertical direction between the pulleys so as to cause the limbs to flex. In the relaxed strung condition of the bow, the magnitudes of these forces are represented as $F_{1R}$, $F_{2R}$, and $F_{3R}$, respectively.

As shown in FIGS. 5 and 6, the quantity $r_1$ is defined as the distance between pulley rotational axis 22 and the line of action of force $F_1$, and the quantity $r_2$ is correspondingly defined as the distance between the pulley rotational axis 22 and the line of action of force $F_2$, i.e., to the point 55 where bus portion 30 of the cable is tangent to pulley groove 39. In the relaxed state of the bow, $r_1<r_2$, but in the drawn state of the bow $r_1>r_2$. The quantities $r_1$ and $r_2$ are variables due to the eccentric mounting of the pulley on axle 20.

In bow 10, $F_2=F_3$ at any instant as a result of symmetry of the bow. At full draw, $F_1$ is on the order of 2 to 3 times the magnitude of $F_2$. In the relaxed state of the bow, $F_1$ is greater than $F_2$. In either the drawn or relaxed states of the bow, it is not necessary that $F_1 r_1=F_2 r_2$ because, in both states, the bow is at its limits of operation and the principles of static equilibrium do not necessarily apply to an analysis of forces acting on the pulley; such principles would apply for any fixed condition of the pulley between these two states.

Figure 11:
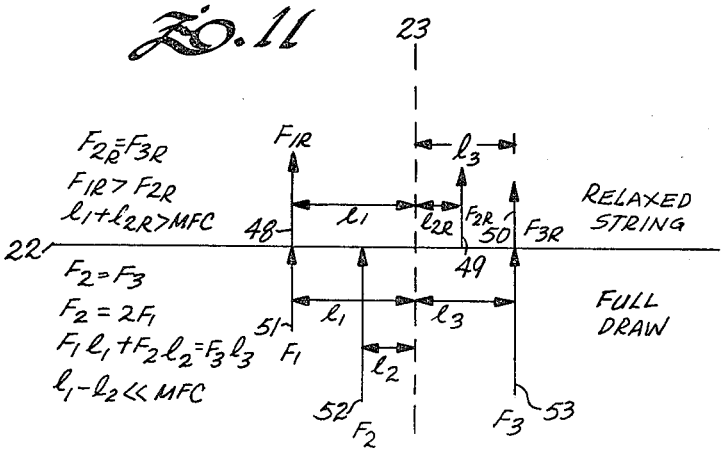
FIG. 11 is a force diagram illustrating the relationships between the forces applied to the tip of a limb in the bow shown in FIGS. 1 and 2 by the shooting string and the bus cables at both the full draw and relaxed strung conditions.

FIG. 11 illustrates an analysis of torsional loads imposed on either limb of bow 10 both at the relaxed strung condition shown in FIG. 1 and the full draw condition shown in FIG. 2. The arrows 48, 49, 50, 51, 52 and 53 represent forces applied to pulley axis 22 relative to limb torsional axis 23. Each cable portion has an effective point of application of rigging cable tension load to the pulley. The opposite cable dead end has an effective point of application of load on the axle. Each cable produces a torsional moment about limb torsional axis 23 equal to the product of cable tension multiplied by the distance from the limb torsional axis at which the relevant cable tension is applied to the pulley or the pulley axis. In FIG. 11, arrows 48 and 51 represent the tension in the shooting string 31 at the relaxed state $F_{1R}$ and the drawn state $F_1$ of the bow, respectively. Arrows 50 and 53 represent the tension in opposite cable dead end 28 at the relaxed state $F_{3R}$ and the drawn state $F_3$, respectively. The locations of application of these tensions to the limb (to the pulley for $F_1$ and $F_{1R}$ and to the axle for $F_3$ and $F_{3R}$) are fixed relative to torsional axis 23. Arrows 49 and 52 represent the tension in bus cable 30 in the relaxed state $F_{2R}$ and the drawn state $F_2$, respectively.

Referring to the full draw portion of FIG. 11, tension 51 for shooting string 27, at full draw of the bow, has a magnitude $F_1$. In the full draw state of the bow, shooting string cable portion 27 is displaced a distance $l_1$ from limb torsional axis 23. In the presently preferred embodiment, pulley groove 38 for the shooting string end is defined entirely in a plane perpendicular to axis 22. As a consequence, shooting string cable portion 27 has an effective point of application of rigging cable tension load to the pulley which is displaced a constant distance by torque arm $l_1$ from limb torsional axis 23 for any condition of bow draw. Shooting string end 27 exerts a torsional moment about limb torsional axis 23, equal to the product $F_1 l_1$.

Tension 52 for bus cable 30 at full draw of the bow has a magnitude $F_2$. At full draw of the bow, bus cable portion 30 has an effective point of application which is displaced by torque arm $l_2$ from limb torsional axis 23. Bus cable portion 30 exerts a torsional moment about limb torsional axis 23 equal to the product $F_2 l_2$ at full draw.

In the presently preferred new pulley, the spacing between pulley grooves 38 and 39 varies at different locations along the length of groove 38. As a consequence, bus cable 30 has an effective point of application of rigging cable tension load to the pulley which is displaced a variable distance $l_2$ from limb torsional axis 23 for different conditions of bow draw. In the presently preferred pulley, the separation between the shooting string groove and the bus cable groove at the relaxed strung condition, $l_1+l_{2R}$, is not equal to and is greater than the corresponding separation at or near the full draw condition of the bow, $l_1-l_2$. The spacing of the bus cable groove from the plane of the shooting string groove at locations along the bus cable groove corresponding to the relaxed state of the shooting string, and states closely proximate thereto, is sufficient to enable arrow fletches to pass the bus portion of the cable without contact. This spacing is greater than at the location along the bus cable groove corresponding to the fully drawn state of the shooting string.

Tension 53 in opposite cable dead end 28, at full draw of the bow, has a magnitude $F_3$. Opposite cable dead end portion 28 is seized about axle 20 and has an effective point of application of load on the axle which is displaced from limb torsional axis 23 a constant distance by torque arm $l_3$ at any condition of draw of the bow. Opposite cable dead end portion 28 exerts a torsional moment about limb torsional axis 23 at full draw equal to the product $F_3 l_3$.

The opposite cable dead end is effectively connected to the limb a substantial distance $l_3$ from the limb torsional axis on one side of the axis. The cable shooting string end and bus portions are engaged with the pulley at the full draw state proximate to each other on the other side of the limb torsional axis.

At full draw of the bow, the tension in bus cable 30 is equal to the tension in opposite dead end portion 28 due to the symmetry of the bow. Thus, at full draw, $F_2$ equals $F_3$. At full draw of the bow, $r_1$ is greater than $r_2$ due to the eccentricity of the pulley and the rotation of the pulley. The force on either bus cable portion 30 at full draw is larger than the force on shooting string end portion 27. The relative magnitudes of $F_1$ and $F_2$ approximates the ratio $r_1/r_2$ and is a function of the eccentricity of the pulley, the rotation of the pulley and the condition of draw of the bow. In the presently preferred embodiment, at full draw of the bow, $F_2$ is equal to about twice the magnitude of $F_1$. In conventional compound shooting bows, the relative magnitudes of $F_2$ and $F_1$ is on the order of about 1.5 to about 3.

In the relaxed strung state of the bow, the tensions on shooting string end 27, bus cable 30, and opposite cable dead end 28 on each limb, are $F_{1R}$, $F_{2R}$, and $F_{3R}$. At full draw of the bow, these tensions are, respectively, $F_1$, $F_2$, and $F_3$. As the bow is drawn from a relaxed strung condition to full draw, the magnitudes of the tensions on the bus cables gradually increases, while the magnitude of tension $F_1$ on the shooting string reaches a maximum and then decreases due to the eccentricity of the pulley and the rotation of the pulley. The phenomena of decrease in the magnitude of shooting string tension $F_1$ is well known and is characterized as letoff. Even taking letoff into account, the magnitude of the tension on the shooting string at full draw is greater than that at a relaxed string condition of the bow. Thus, $F_1$ is greater than $F_{1R}$. The magnitude of the tension on each bus cable is greater at full draw than at the relaxed string condition of the bow, where the tensions are at their minimum values. Thus, $F_2$ is greater than $F_{2R}$ and $F_3$ is greater than $F_{3R}$.

Torque acting on either limb 17 may be expressed as the sum of torsional moments about that limb's torsional axis. Thus, torque acting about limb 17 is equal to the sum $F_1 l_1 + F_2 l_2 + F_3 l_3$ at full draw.

The rigging of bow 10 is arranged so that, at full draw, the torsional moment on each limb arising from the opposite cable dead end is substantially equal to the sum of the torsional moment arising from the bus portion of the cable added to the torsional moment arising from the shooting string end of the cable, about that limb's torsional axis. In the drawn state of the bowstring, the effective points of application of the rigging cable tension loads to the pulley, and of the opposite cable dead end limb load on the axle, are cooperatively related to each other and to the magnitudes of said loads to impose on the limb no significant moment about its torsional axis. At full draw, the location of the point of application of the opposite cable dead end load to the axle is disposed on one side of the limb torsional axis relative to the locations of application of tension loads of the cable portions connected to the pulley. This cooperative relation is expressed by the equation $F_1 l_1 + F_2 l_2 = F_3 l_3$, depicted in the full draw portion of FIG. 11. This, in the drawn state of the bowstring, the product of (a) the opposite cable dead end load times the distance of the location of connection of the opposite cable dead end from the limb torsional axis, $F_3 l_3$, is essentially equal to (b) the sum of (i) the tension in one portion of the rigging cable adjacent the pulley times the distance of the location of application of such tension to the pulley from the limb torsional axis, $F_1 l_1$, and (ii) the tension in the other portion of the rigging cable adjacent the pulley times the distance of the location of application of such tension to the pulley from the limb torsional axis, $F_2 l_2$.

Figure 8:
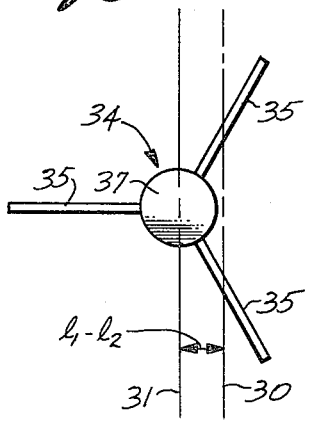
FIG. 8 is a rear elevation view of an arrow illustrating the relation between the shooting string and the bus cables at full draw of the bow as shown in FIG. 2.

In the full draw condition of FIG. 11, the effective points of application for the active bus cable portion 30 and the shooting string end 27 lie close together on the same side of limb torsional axis 23. The lateral separation along axis 22 between the bus cables and the shooting string is the difference between torque arms $l_1$ and $l_2$. In FIG. 8 the rear end of an arrow 34 carrying fletchings 35 is shown strung on shooting string 31 at full draw of the bow. Each bus cable portion 30 is displaced from shooting string 31, by the difference between the quantities $l_1$ and $l_2$. The spacing between bus portions 30 and shooting string 31 at full draw is not adequate to permit fletchings 35 of the arrow to pass bus cables 30 without contacting either bus cable. However, this is not troublesome, because in the full draw state shown in FIG. 8, the arrow fletchings are located some distance away from the location where bus cables 30 pass the arrow shaft, as shown in FIG. 2.

Figure 7:
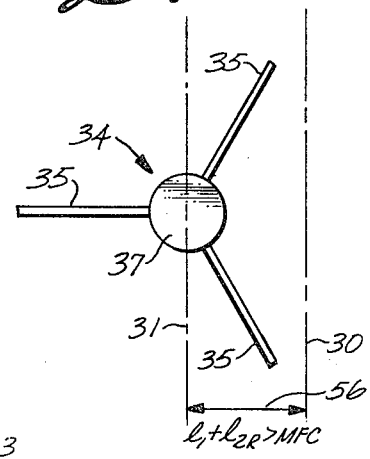
FIG. 7 is a rear elevation view of an arrow illustrating the minimum fletching clearance MFC required between the shooting string and the bus cable at about the relaxed strung condition of the bow as shown in FIG. 1.

In the relaxed strung state of the bow as shown in FIG. 11, the active bus cable portion 30 and shooting string end 27 are reeved on grooves situated on opposite sides of limb torsional axis 23. The distance between the locations of application to the pulley of the tensions in shooting string end 27 and bus cable portion 30 is expressed as the sum of the torque arms $l_1$ and $l_{2R}$. In FIG. 7, representing the rigging configuration at or near the relaxed strung condition of the bow, an arrow 34 carrying fletches 35 is strung on shooting string 31. Each bus cable 30 is displaced a distance from shooting string 31 equal to the sum of the quantities $l_1 + l_{2R}$. The spacing between bus cable 30 and shooting string 31 is sufficient at the relaxed strung condition of the bow to permit arrow 34 to fly past bus cables 30 without contact of fletchings 35 with either bus cable 30. There is an adequate fletching clearance between bus cables 30 and shooting string 31 at or near the relaxed state of the bow.

The geometry shown at the full draw condition in FIG. 11 results in inadequate fletching clearance. However, it is at the full draw condition of the bow that limb bending stresses are highest. At the full draw condition of a bow rigged in accordance with principles of this invention, there is substantially no torque imposed on either limb of the bow. Each pulley is mounted to the adjacent limb in a manner which prevents torsion of the limb at full draw of the bow. As to each limb, the connections of the opposite cable dead end to the limb and of the location of application of the adjacent cable bus portion and shooting string end portion tensions on the pulley axle are arranged, in respect to the magnitudes of these tensions at full draw of the bow, to apply no net moment to the limb about the limb torsional axis.

Regarding the relaxed strung condition shown in FIG. 11, there is adequate fletchings clearance between the shooting string and the adjacent active bus cable portion 30. In the relaxed strung condition of the bow, the summation of angular moments about limb torsional axis 23 does not necessarily equal zero, but this does not present a problem. At or near the relaxed strung state of the bow, the limb bending stresses are relatively low, compared to the stresses present at full draw, and the arrow is on the verge of releasing from the shooting string. At such a time, the magnitudes of the several string and cable forces 48, 49 and 50 are relatively low, so that any effect from the summation of angular moments being different from zero, on each limb, is acceptably small. The result is that at or near the relaxed strung state of the bow, there is no appreciable torque nor torsional deflection appearing in either limb. The shooting string nocking point 32 moves only along the intended line of flight of the arrow and not with any significant lateral motion. The result is that substantially no cast is imparted to the arrow.

The net effect of arrangement shown in the full draw portion of FIG. 11 is to recapture most of the advantages of a parallel pulley, save for the problem of inadequate fletchings clearance, which could be handled by conventional means, such as by the use of a bus cable deflecting probe. However, when the pulley is arranged to also produce the arrangement shown for the relaxed strung condition, the problem of inadequate fletchings clearance is solved without resorting to a probe.

This invention provides the benefits of both of the arrangements shown in FIG. 11 in the same pulley by defining the shooting string groove 38 in a plane normal to the pulley rotational axis 22 and defining the bus cable groove 39 in the presently preferred pulley in a substantially helical manner relative to the plane on the pulley surface. The substantially helical configuration of bus cable groove 39 enables the active bus cable point of departure 55 from the pulley to move laterally in a direction parallel to pulley rotational axis 22 as the pulley turns, in drawing the shooting string from a relaxed strung condition of the bow to full draw, or vice versa. Thus, for states of the bow other than that corresponding to the drawn state of the bowstring, the distance from the limb torsional axis of the location of application of the tension in the bus portion of the rigging cable is different from the distance pertinent to full draw.

Shooting string pulley groove 38 in the presently preferred embodiment of this invention is defined entirely in a plane perpendicular to the pulley axis of rotation 22. The shooting string does not move significantly in a lateral direction as the bow is operated. No significant cast is imposed on the arrow.

The active bus cable groove 39 is defined in the pulley to cause the bus cable-to-shooting string clearance to increase to reach adequate fletching clearance as the nocking point 32 of the shooting string moves from full draw to the relaxed strung condition of the bow. In the relaxed strung state of the bowstring and in states of the bowstring adjacent the relaxed state, the distance between the locations of application to the pulley of the tensions in the portions of the cable on opposite sides of the pulley is greater than a fletching clearance distance pertinent to an arrow useful with the bow.

The rate of change of bus cable to shooting string clearance 56 can be linear or nonlinear with nocking point movement. Nonlinear variation may be practiced to maintain the summation of angular moments substantially equal to zero for as long as possible following release of the shooting string. A condition where the summation of angular moments about limb torsional axis 23 is substantially equal to zero preferably is maintained at least until the limb bending stresses reduce significantly and the fletchings 35 begin to closely approach bus cables 30.

FIG. 23 is a graphical representation of design considerations pertinent to a pulley according to this invention. On the vertical axis, bowstring to bus cable clearance and stress are plotted against bowstring draw on the horizontal axis. The origin on the horizontal axis represents the relaxed strung condition R of the bow and the maximum extent of the abcissa represents the fully drawn condition FD of the bowstring. The origin on the ordinate is set for zero stress and no bowstring to bus cable clearance. As shown in FIG. 23, limb bending stress 72 is plotted as a function of bowstring drawn from a minimum inherent value 73 at the relaxed strung condition to an increasing value at full draw. Parameter 74 represents the length of the arrow fletchings as a function of bowstring draw. Parameter 74 represents the condition of bowstring draw at which the front end of the arrow fletchings begins to pass the bus cables. Parameter 75 represents the width of the arrow fletchings plotted as a function of bowstring to bus cable clearance. Parameter 75 represents the minimum fletching clearance required at or near the relaxed strung condition of the bowstring. The curve labeled 'prior art' represents the torsional stress in a prior art bow which rises from a minimum value 73 at the relaxed strung condition of the bow to a sharply increasing value near full draw of the bow. Step function 76 represents a theoretically useful configuration for the bus cable groove if torque is to be kept to a minimum for as long as possible before the arrow fletchings begin to approach the bus cables. However, in operation, a step function is an unacceptable configuration for the bus cable groove because no cable will track such a groove.

Curve 79 represents a pulley embodiment using a harmonic variation in the spacing of bus cable groove 39 from shooting string groove 38. Curve 79 is determined by balancing torsional moments about the torsional axis of the limb as a function of bowstring draw. Since the relative magnitudes of the forces on the shooting string and the bus cable are related by the ratio $r_1/r_2$, relative magnitude is a function of the eccentricity of the pulley and the condition of draw of the bowstring. The relative magnitudes of $F_1$ and $F_2$ will vary substantially harmonically as the bow is drawn from a relaxed strung condition to full draw. Since the displacement of the shooting string cable portion is kept at a fixed distance from the limb torsional axis, and the effective point of application of the opposite cable dead end load is a constant distance from the limb torsional axis, the variable that must be adjusted to balance the torsional moments is the effective point of application of the bus cable load from the limb torsional axis. Since the relative magnitudes of the cable tensions on the pulley vary as a substantially harmonic function affected by the pulley eccentricity and the condition of draw of the bowstring, the configuration of the pulley groove (and the location of the effective point of application of the bowstring load to the limb) will also vary as a substantially harmonic function if all torsional moments about the limb torsional axis are to be balanced for all conditions of bowstring draw at least until the front end of the arrow fletchings begins to pass the bus cables. For this embodiment, for states of the bow other than that corresponding to the drawn state of the bowstring, the distance from the limb torsional axis to the location of application of the tension in the active bus portion of the rigging cable varies substantially harmonically from the distance pertinent to full draw.

Curve 77 represents the torque arising from a substantially harmonic bus cable groove; torque is zero as the bow is released from full draw and stays at a value of zero until parameter 74 is reached, at which point curve 77 rises to reach a maximum value 78 at the relaxed strung condition of the bow.

It has been found by experimentation that a harmonic configuration for the bus cable groove, while useful, is expensive to manufacture. However, a substantially helical groove has been found by experimentation to be easy to manufacture and effective in substantially eliminating torque about the limb torsional axis both at full draw and for a substantial distance from full draw toward the relaxed strung state; curve 80 represents the configuration for the active bus cable groove in the presently preferred pulley 19 described above. Torque arising from use of a helical groove as an approximation to a harmonic configuration is plotted, as curve 81, as a function of bowstring draw. At conditions at or near full draw of the bow, when limb bending forces are greatest, torque about the limb torsional axis is substantially eliminated. When the bowstring is released, the condition of draw approaches the relaxed strung condition and the limb bending forces reduce substantially. During this process, the relative magnitudes $F_1$ and $F_2$ vary substantially harmonically and a small amount of torque arises and increases to maximum value 78 at the relaxed string condition of the bow. At all conditions of bowstring draw, torque about limb torsional axis 23 is kept acceptably small so that any deflection of the limb tips will be insignificant. To practice this invention, it is not necessary that the scheme for the active bus cable pulley groove be uniform for the entire extent of the groove. It is necessary, however, that torque at or near full draw be substantially eliminated and that at or near the relaxed strung condition, there be an adequate clearance between the shooting string and the bus cables for the arrow fletchings.

In the presently preferred new pulley of this invention, rigging cable 26 crosses the interior of the pulley along a path which is substantially perpendicular to the pulley diameter on which pulley rotational axis 22 is located. The shooting string groove 38 and the active bus cable groove 39 preferably are closest to each other along the pulley rim surface adjacent the axle hole 24.

In a given compound bow, the diameter of a pulley for the shooting string groove is a direct function of draw length. In the presently preferred embodiments of this invention the helix angle is set between about 5° and about 7°. For larger pulleys, the active bus cable groove helix angle can be made smaller than for smaller pulleys.

The presently preferred embodiment of the new pulley is illustrated in FIG. 13, FIG. 14, FIG. 15, and FIG. 16. As can be seen from these figures, shooting string groove 38 is defined entirely in a plane perpendicular to pulley rotational axis 22. Active bus cable groove 39 is defined helically around the greater part of the circumference of the pulley. As shown in FIG. 14 and FIG. 15, active bus cable groove 39 includes a dwell portion 60 which is substantially parallel to the plane defining the shooting string groove. Dwell 60 connects pulley groove 39 with rigging cable passage means 40 at second selected location 42 which is defined along the dwell portion. The passage means second location is preferably defined along the groove dwell portion at its terminus. The dwell portion is positioned along the second groove at locations corresponding to the relaxed strung state of the shooting string and states closely proximate thereto. Dwell 60 functions to maintain a condition of maximum spacing between shooting string pulley groove 38 and active bus cable groove 39 for a greater portion of the pulley circumference than would be permitted by a simple helical configuration for the entire extent of groove 39. A condition of adequate fletching clearance between the shooting string and the bus cables is thereby maintained for states of the bow both at and near the relaxed string condition.

FIG. 17 is an elevation view of alternate new pulley 62 for a compound shooting bow. Pulley 62 has an axlehole 61 defining a pulley rotational axis 63 and has side surfaces 65 and 66 transverse to the pulley axis of rotation. Side surface 65 has a flat 64. FIGS. 18, 19, 20, and 21 are views of pulley 62 taken as indicated in FIG. 17. Shooting string groove 38 is defined entirely in a plane substantially normal to the pulley rotational axis 63.

Side surface 66 is substantially parallel to the pulley groove closest to it; i.e., groove 38. Side surface 65 is located closest to the other groove 39. As shown in FIG. 19 and FIG. 21, flat 64 is a substantially planar chordal region which is defined substantially entirely in a plane normal to pulley rotational axis 63 and parallel to the plane in which groove 38 is defined. Flat 64 permits use of alternate pulley 65 in bows using split limbs having narrow croches. Flat 64 also eliminates an undesirable 'twang' sound which had sounded on bows using pulleys similar to pulley 62 but without the flat. As shown in FIG. 20, groove 38 includes first selected location 41 for connection to cross-pulley cable passage means 40. Bus cable groove 39 is defined substantially helically relative to the plane of groove 38. Side surface 65 generally is parallel to helical groove 39, except for flat 64, which is parallel to groove 38.

The new pulley, in its preferred form, has additional novel features. FIG. 22 is a cross-section view of pulley 19. Pulley grooves 38 and 39 are defined along the circumference of the pulley rim. Pulley 10 has a pulley axle bearing bushing 68 surrounding an axlehole 24 for mounting the pulley on axle 20. Axle oil hole 67 is defined to permit access to the pulley axle bearing for lubrication purposes. The outer portion of axle oil hole 67 may be tapered to facilitate easy lubrication, and may be closed by conventional securing means, such as a screw, to prevent dirt and dust from entering.

The presently preferred pulley as shown in FIG. 5, is annular in substantially the form of a ring 16 having a thickness between inner and outer ring radii which is substantially less than the inner ring radius. The pulley has a right circularly cylindrical rim surface. As shown in FIG. 5, pulley 19 includes a lug-shaped projection 101 extending radially inwardly from ring 16 across the axis of rotation 22. Axle hole 24 defining the pulley axis of rotation 22 is formed through the projection in a direction parallel to the cylindrical rim surface.

Pulley 19 preferably is fabricated from an extrusion having the annular cross-sectional configuration shown in FIG. 5, e.g., the ring including the projection 101, but without axle hole 24. The material of the extrusion preferably is aluminium. The use of an extrusion to define the basic workpiece from which the pulley is fabricated leads to substantial economies in manufacture of the pulley.

To fabricate a pulley, the annular extrusion is cut into slices having a width between end faces 99 and 100 (see FIG. 22) equal to the width of the pulley parallel to its axis of rotation. The radially inwardly extending lug-shaped projection 101, in which the axle hole ultimately is formed, is machined down at each end so that the lug has a width between its end faces 102 which is less than the pulley width as shown in FIG. 22. Axle hole 24 is then machined in the lug. The pulley can accomodate an axle that is of a larger diameter that conventional pulley axles, which have a 3/16" diameter, in order to reduce bearing unit loads and thus reduce friction in the mounting of the pulley to its axle.

Grooves 38 and 39 are then machined in the circumference of the pulley. Oil hole 67 and cable passage 40 are also machined. Bearing bushing 68 is installed. Low-friction self-lubricating bearing sleeves may be utilized in the pulley axle bearing. Preferably these sleeves are made of polytetrafluoroethylene, although they may be made of other suitable low-friction substances.

If desired, the pulley may be anodized to enhance corrosion resistance and to impart a desired color before the bearing bushing is installed. The use of an extrusion as the basic pulley workpiece results in more accurate and uniform pulleys which are substantially less costly to manufacture than the fully machined pulleys heretofore known.

Persons skilled in the art to which this invention pertains will appreciate that the preceding description has been presented with reference to the embodiments of the invention illustrated in the accompanying drawings.

It will be understood, however, that the present invention can be manifested in structural and procedural embodiments different from those described. The preceding description sets forth the presently known best mode of practicing the invention, but certainly not all possible modes. Accordingly, workers skilled in the art will readily appreciate that modifications, alternations or variations in the arrangements and procedures described above may be practiced without departing from, and while still relying upon, the essential aspects of this invention.

What is claimed is:

1. An eccentric pulley for a compound archery bow, the pulley including means defining an axis of rotation eccentric to a pulley rim surface which extends at least partially around the circumference of the pulley, the rim surface defining therein first and second grooves extending at least partially along the rim surface of the pulley, the first groove being defined entirely in a plane normal to said axis, the second groove being spaced from said plane with the amount of such spacing varying over at least a portion of the length of the second groove, and rigging cable passage means defined through the pulley from a first selected location on the first groove to a second selected location on the second groove spaced circumferentially along the rim surface from the first location.

2. Apparatus according to claim 1 in which the spacing of the second groove from the plane varies between points of minimum and maximum spacing, such points being separated along the rim surface, and in which the second groove includes a dwell portion defined parallel to said plane, the dwell portion commencing substantially at the point of maximum spacing and extending to the second selected location.

3. Apparatus according to claim 1 in which the amount of said spacing varies as a harmonic function to the eccentricity of the pulley and of the rotation of the pulley.

4. Apparatus according to claim 1 wherein the pulley has sides transverse to the pulley axis of rotation and at least one of the grooves is defined substantially parallel to the pulley side which is closest to such groove.

5. Apparatus according to claim 4 wherein both sides of the pulley are normal to the pulley axis.

6. Apparatus according to claim 4 wherein both of the pulley sides are substantially parallel to the pulley groove which is closest to the respective side.

7. Apparatus according to claim 1 in which the variation in spacing of the second groove from the plane is a substantially helical variation.

8. Apparatus according to claim 7 in which the pulley has sides transverse to the pulley rotational axis, and the side located closest to the second groove includes a chordal portion defined substantially entirely in a plane normal to the pulley rotational axis.

9. Apparatus according to claim 1 further comprising mounting means for mounting the pulley on an axle.

10. Apparatus according to claim 9 including low-friction self-lubricating axle bearing means carried by the pulley.

11. Apparatus according to claim 10, in which the bearing means comprises polytetrafluoroethelene.

12. Apparatus according to claim 1 in which the grooves are closest to each other adjacent the pulley rotational axis.

13. Apparatus according to claim 1 wherein the pulley rim surface is a right cylindrical surface having a directrix parallel to said axis of rotation.

14. Apparatus according to claim 13 wherein the rim surface is a right circularly cylindrical surface.

15. Apparatus according to claim 13 wherein the cylindrical rim surface is closed so as to extend entirely about the pulley axis of rotation.

16. Apparatus according to claim 15 wherein the pulley is annular in substantially the form of a ring having a thickness between inner and outer ring radii which is substantially less than the inner ring radius.

17. Apparatus according to claim 16 including a projection extending inwardly from the ring across the axis of rotation.

18. Apparatus according to claim 17 wherein the ring, including the projection, are extruded.

19. Apparatus according to claim 17 wherein the means defining the pulley axis of rotation comprises an axle passage formed through the projection parallel to the cylindrical rim surface.

20. Apparatus according to claim 13 wherein each element of the cylindrical surface is a line extending between axially spaced opposite end surfaces of the pulley and lying at a constant distance from the axis at all points therealong between the end surfaces.

21. Apparatus according to claim 1 wherein the grooves, at any location about the circumference of the pulley, are spaced equidistantly from the axis of rotation.

22. An eccentric pulley for a compound archery bow, the pulley including means defining an axis of rotation eccentric to a pulley rim surface which extends at least partially around the circumference of the pulley, first and second grooves defined in and extending at least partially along the rim surface of the pulley, rigging cable passage means defined through the pulley from a first location on the first groove to a second location on the second groove spaced circumferentially along the rim surface from the first location, in use the first and second grooves being associated with, respectively, a shooting string end portion and a bus portion of a rigging cable of a compound archery bow, so that the shooting string end portion of the cable contacts the pulley rim surface at a first point of departure on the first groove and is reeved in the first groove to the first location to enter the rigging cable passage means, and the bus portion of the cable contacts the pulley rim surface at a second point of departure on the second groove and is reeved in the second groove to the second location to enter the rigging cable passage means, the first groove being defined entirely in a plane normal to the pulley axis of rotation, the second groove being spaced from the plane in a direction parallel to the axis of rotation with the amount of such spacing varying over at least a portion of the length of the second groove so that upon rotation of the pulley from a rest position to a full draw position, the second point of departure of the bus cable from the pulley rim surface moves parallel to the pulley axis of rotation relative to the first groove.

23. An eccentric pulley according to claim 22 wherein the amount of spacing of the second groove from the first groove is least adjacent the axis.

24. An eccentric pulley according to claim 22 wherein the amount of spacing of the second groove from the first groove is greatest substantially at the place on the pulley where the second groove is farthest from the axis of rotation.

* * * * *

UNITED STATES PATENT AND TRADEMARK OFFICE

CERTIFICATE OF CORRECTION

PATENT NO. : 4,340,025

DATED : July 20, 1982

INVENTOR(S) : Joseph M. Caldwell

It is certified that error appears in the above-identified patent and that said Letters Patent are hereby corrected as shown below:

Column 3, line 30, "limp" should read -- limb --. Column 7, line 67, "axis" should read "axle". Column 8, line 17, "transversly" should read -- transversely --; line 46, after the word "invention" delete one ",". Column 11, line 49, "axis" should read -- axle --. Column 15, line 53, "drawn" should read -- draw --. Column 18, line 12, "10" should read -- 19 --. Column 19, line 9, "alternations" should read -- alterations --; line 39, after the word "function" change the "to" to read -- of --; line 65, "polytetrafluoroethelene" should read -- polytetrafluoroethylene --.

Signed and Sealed this

*Twenty-first* Day of *September 1982*

[SEAL]

*Attest:*

GERALD J. MOSSINGHOFF

*Attesting Officer*

*Commissioner of Patents and Trademarks*